US009759155B2

(12) United States Patent
Facciano

(10) Patent No.: US 9,759,155 B2
(45) Date of Patent: Sep. 12, 2017

(54) ENHANCED PERFORMANCE POPPET VALVES FOR INTERNAL COMBUSTION ENGINES

(71) Applicant: Joseph Facciano, Burbank, CA (US)

(72) Inventor: Joseph Facciano, Burbank, CA (US)

( * ) Notice: Subject to any disclaimer, the term of this patent is extended or adjusted under 35 U.S.C. 154(b) by 0 days.

(21) Appl. No.: 14/308,334

(22) Filed: Jun. 18, 2014

(65) Prior Publication Data

US 2015/0369168 A1 Dec. 24, 2015

(51) Int. Cl.
*F02F 1/42* (2006.01)
*F02F 1/24* (2006.01)

(52) U.S. Cl.
CPC ..... *F02F 1/4285* (2013.01); *F02F 1/4214* (2013.01); *F02F 2001/247* (2013.01)

(58) Field of Classification Search
CPC .... F02F 1/42; F02F 1/24; F02F 1/4285; F02F 2001/241; F02F 2001/244; F02F 2001/245; F02F 2001/247; F02F 1/4214
See application file for complete search history.

(56) References Cited

U.S. PATENT DOCUMENTS 5,069,178 A * 12/1991 Kawamura ..... F02B 19/00 123/256
5,163,395 A * 11/1992 Ishii ..... F02F 1/4214 123/193.5
2005/0022768 A1* 2/2005 Tores et al. ..... 123/90.41
2013/0263813 A1* 10/2013 Fouquet ..... F02F 1/24 123/193.5
2014/0048033 A1* 2/2014 Hess et al. ..... 123/193.5

* cited by examiner

*Primary Examiner* — Jacob Amick
(74) *Attorney, Agent, or Firm* — James A. Italia; Italia IP

(57) ABSTRACT

A valve arrangement for an internal combustion engine having at least one intake valve, at least one exhaust valve, and at least one reciprocating piston. Each intake valve is seated in the cylinder head at a lesser distance from the piston than is each exhaust valve. Also, each exhaust valve has a cross sectional area less than seventy percent of the cross sectional area of each intake valve. The cross sectional area of each exhaust valve may be for example sixty to sixty-two percent of the cross sectional area of each intake valve.

4 Claims, 2 Drawing Sheets

ENHANCED PERFORMANCE POPPET VALVES FOR INTERNAL COMBUSTION ENGINES

FIELD OF THE INVENTION

The present invention relates to internal combustion engines, and more particularly to proportions of poppet valves in reciprocating piston engines.

BACKGROUND OF THE INVENTION

It has long been a goal to maximize power output of internal combustion engines. One of the avenues available to the engine designer is that of valve arrangements. Internal combustion engines have traditionally been provided with a plurality of poppet valves having circular heads, there being at least one intake valve and at least one exhaust valve. It is generally known that increasing valve area increases the ability of the engine to induct combustion air and discharge spent exhaust. However, the dynamics of engine breathing are such that additional considerations play a role in determining breathing ability and associated power output of an engine.

SUMMARY OF THE INVENTION

The present invention addresses increased engine power in several ways.

To this end, the invention contemplates locating valves in the combustion chamber relative to one another in a way that optimizes breathing and hence power output, and sizing the valves as is most effective to promote breathing and increase power.

It is an object of the invention to provide improved elements and arrangements thereof by apparatus for the purposes described which is inexpensive, dependable, and fully effective in accomplishing its intended purposes.

This and other objects of the present invention will become readily apparent upon further review of the following specification and drawings.

BRIEF DESCRIPTION OF THE DRAWING

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
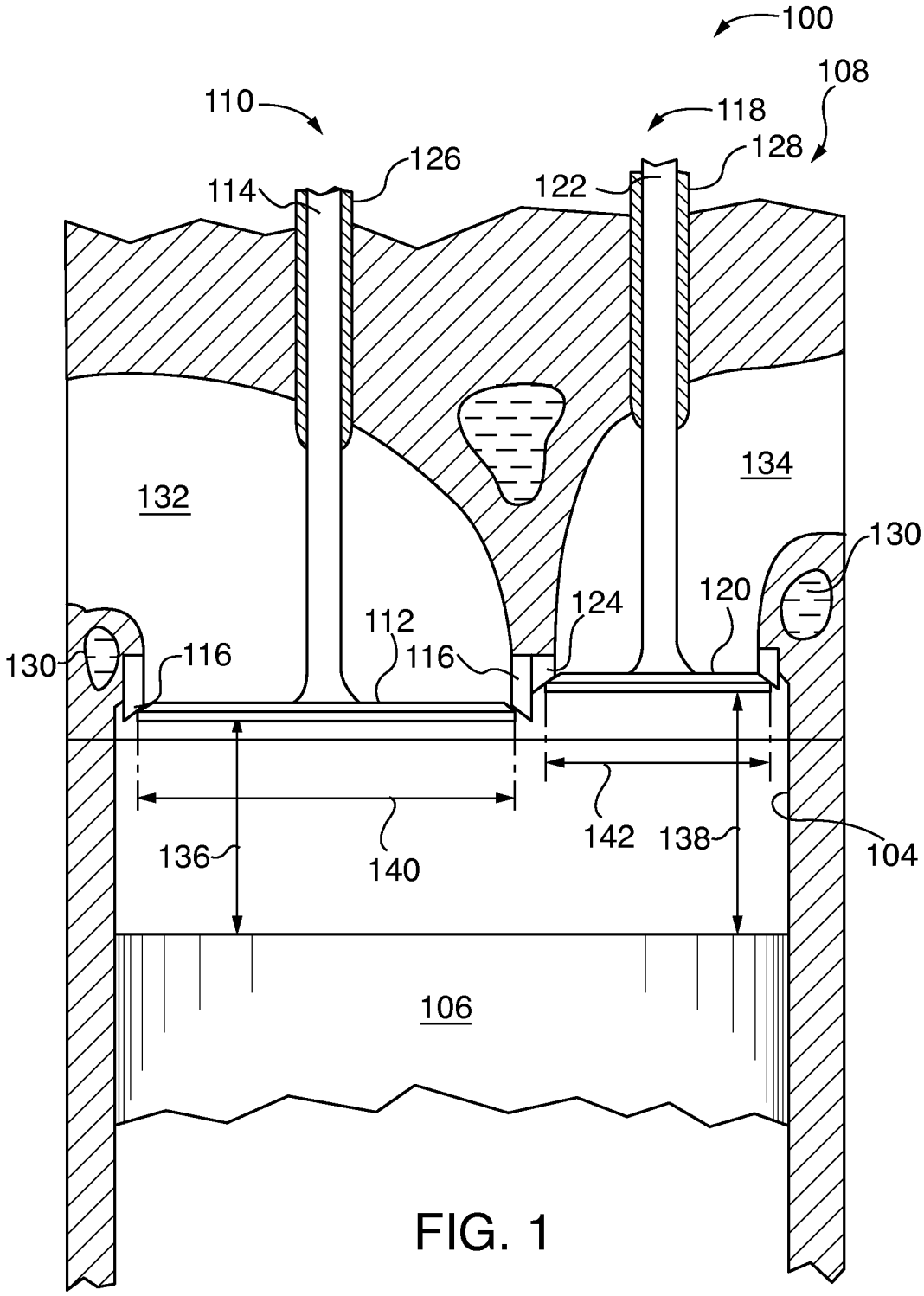
FIG. 1 is a diagrammatic side view of a cylinder assembly of an internal combustion engine, drawn partially in cross section.

Referring to FIG. 1, an internal combustion engine 100 is seen to include an engine block 102 containing at least one cylinder 104, and a piston 106 translatably disposed within the cylinder 104. A cylinder head 108 is at one end of the cylinder 104. The cylinder head 108 includes an intake valve 110 having a valve head 112 and a valve stem 114. The valve head 112 seats against an intake valve seat 116 which is part of the cylinder head 108. The cylinder head 108 also includes an exhaust valve 118 having a valve head 120 and a valve stem 122. The valve head 120 seats against an exhaust valve seat 124.

Construction of the internal combustion engine 100 as described thus far is conventional. The intake and exhaust valves 110, 118 are held within respective valve guides 126, 128 fixed to the cylinder head 108. The internal combustion engine 100 is not shown in its entirety, and will be understood to include a crankshaft, flywheel, connecting rods, oil pan, valve actuation apparatus, intake and exhaust manifolds, starter motor, and support systems such as fuel supply, ignition source, alternator or generator, coolant pump, and lubricating system (none shown). Additional systems (not shown) may be provided, such as pollution control equipment, and engine driven systems such as air conditioning, power steering, power brake system, and the like. Water jackets 130 of a cooling system (not shown in its entirety), an intake port 132, and an exhaust port 134 are provided.

The internal combustion engine 100 may include more than one cylinder 104 (this option is not shown). Where the internal combustion engine 100 includes more than one cylinder 104, components conventionally associated with a cylinder, such as an additional piston (such as the piston 106), intake and exhaust valves (such as the intake and exhaust valves 110, 118), and other engine components would of course be provided so that the internal combustion engine would be operable.

It will be seen that the intake valve seat 116 is located a lesser distance from the piston 106 than is the exhaust valve seat 124. All of intake valve seat 116 is closer to piston 1-6 than is all of exhaust valve seat 124. Cylinder head 108 is seen in FIG. 1 to include an inclined surface facing piston 106. The inclined surface extends from intake valve 110 to exhaust valve 118, and is further from piston 106 at exhaust valve 118 than at intake valve 110. It is also seen in FIG. 1 that a maximum diameter of intake valve 110 is at least half a diameter of cylinder 104. Respective intake and exhaust valves 110, 118 are correspondingly offset from the piston, as reflected by respective dimensions 136, 138. Resultant flow in induction air and exhaust gasses experiences reduced intermingling. Also, location of the exhaust valve 118 away from flow of inducted air avoids interference with orderly flow. These two effects enhance power output of the internal combustion engine 100.

As seen in FIG. 1, valve stem 114 of intake valve 110 and valve stem 122 of exhaust valve 118 are each parallel to the direction of piston travel. Each intake valve 116 abuts a exhaust valve seat 124.

In the internal combustion engine 100, the exhaust valve 118 has a cross sectional area less than seventy percent of the cross sectional area of the intake valve 110. For the purposes of this disclosure, the cross sectional area is the area that controls gas flow through the respective valves. In the internal combustion engine 100, the valve heads 112, 120 of the respective intake and exhaust valves 110, 118 are circular. Therefore, the cross sectional areas of the intake valve 110 and the exhaust valve 118 are proportional to the diameters 140, 142 of the respective valve heads 112, 120. In one example of the internal combustion engine 100, the exhaust valve 118 has a cross sectional area in a range of sixty to sixty-two percent of the cross sectional area of the intake valve 110.

In the internal combustion engine 100 of FIG. 1, there is one intake valve 110 for each cylinder 104, and one exhaust valve 118 for each intake valve 104.

Figure 2:
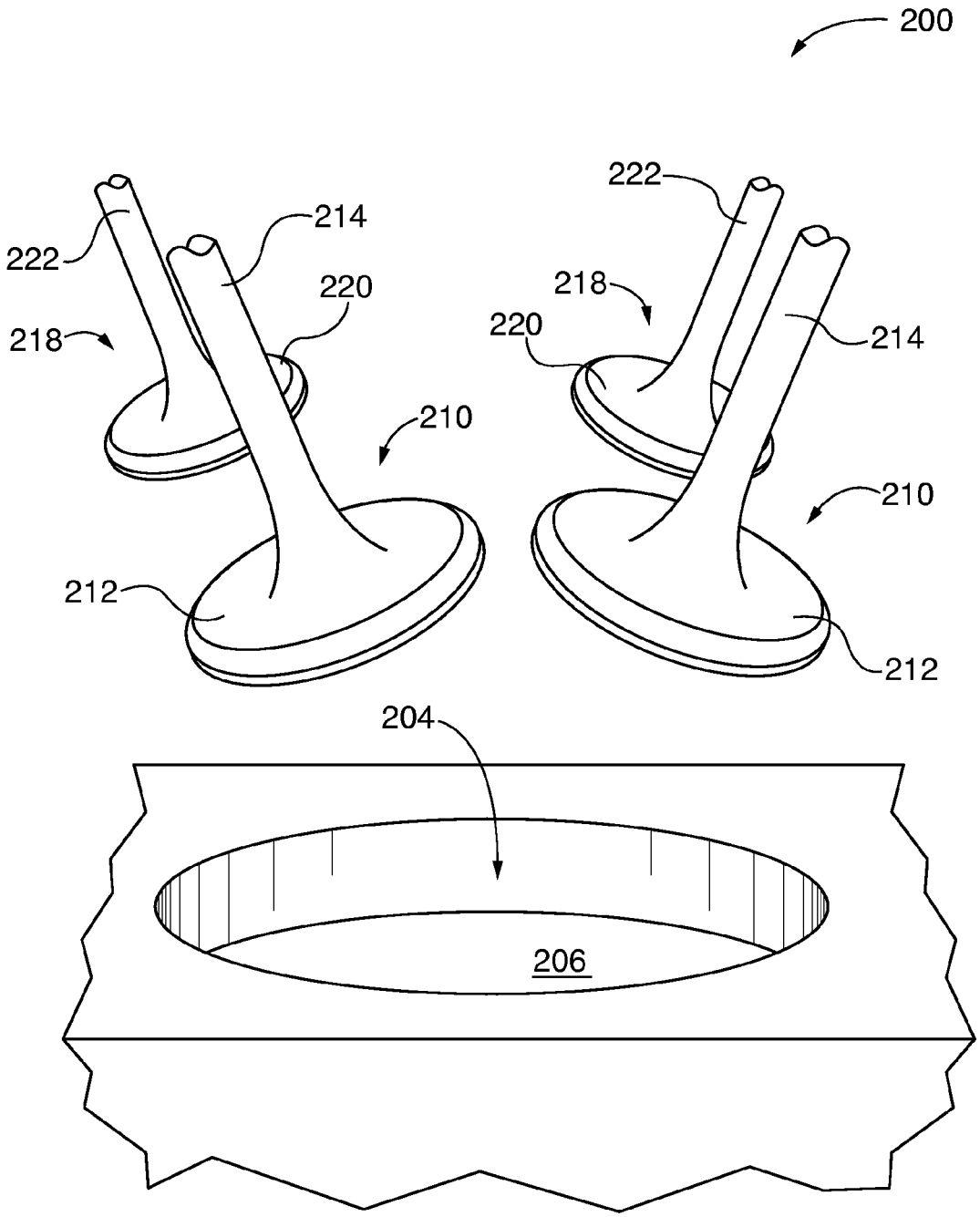
FIG. 2 is a diagrammatic exploded perspective detail view of a cylinder assembly of an internal combustion engine having four valves per cylinder, with some cylinder head structure omitted from the view to reveal detail.

FIG. 2 shows an internal combustion engine 200, which is generally the structural and functional equivalent of the internal combustion engine 100. The difference between the internal combustion engine 100 and the internal combustion engine 200 is that in the latter, there are two intake valves 210 for the cylinder 204, and one exhaust valve 218 for each intake valve 210. Appropriate modification of the valve actuation apparatus (not shown) of the internal combustion engine 100 would be made for the internal combustion engine 200, to allow for the additional valves 210, 218. Regardless of the number of valves provided for each cylinder, there is one intake valve 110 or 210 for each exhaust valve 118 or 218.

It will be understood that, for the internal combustion engine 200, relative offset positioning of valve seats (not shown in FIG. 2, but corresponding to the valve seats 116, 124 in FIG. 1), is the same as that of the internal combustion engine 100. That is, the valve seats of exhaust valves 218 are farther from the associated piston 206 than are the valve seats of intake valves 210. The valve seats have been omitted from FIG. 2 for clarity of view.

Similarly, the ratio of valve areas in the internal combustion engine 200 would be the same as in the internal combustion engine 100. Notably, the valve heads 220 of the exhaust valves 218 have diameters, and hence cross sectional areas, less than seventy percent of corresponding diameters of the valve heads 212 of the intake valves 210. In one example of the internal combustion engine 200, the exhaust valve 218 has a cross sectional area in a range of sixty to sixty-two percent of the cross sectional area of the intake valve 210.

The intake and exhaust valves of any engine according to the disclosed principles may vary from the examples presented herein. For example, the intake and exhaust valves (e.g., 210, 218) of the internal combustion engine 200 could be inclined relative to one another, as seen in FIG. 2, as would accommodate a hemispherical firing chamber, rather than being parallel to one another as illustrated in FIG. 1. Similarly, the intake and exhaust valves 210, 218 of FIG. 2 could be rearranged such that none of the valve stems 214, 222 are parallel to another valve stem 214 or 222. Also, the intake and exhaust valves 210, 218 of FIG. 2 could be arranged in alternating fashion, so that each intake valve 210 is adjacent to two exhaust valves 218, rather than being adjacent to the other intake valve 210 and one exhaust valve 218, as illustrated.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. An internal combustion engine comprising an engine block containing at least one cylinder and at least one piston translatably in each one of the at least one cylinder, and a cylinder head at one end of each one of the at least one cylinder, the cylinder head including, for each cylinder, at least one intake valve, an intake valve seat for each intake valve, at least one exhaust valve for each intake valve, and an exhaust valve seat for each exhaust valve, wherein said exhaust valve has a cross sectional area less than seventy percent of the cross sectional area of said intake valve, wherein each intake valve includes a valve stem parallel to the direction of piston travel, each exhaust valve includes a valve stem parallel to the direction of piston travel, and each said intake valve seat abuts a said exhaust valve seat, and further wherein a maximum diameter of the intake valve is at least half a diameter of the cylinder, all of each said seat for each said intake valve is closer to the piston than is all of said seat for each said exhaust valve, and the cylinder head includes an inclined surface facing the piston, wherein the inclined surface extends from the intake valve to the exhaust valve, and the inclined surface is further from the piston at the exhaust valve than at the intake valve.

2. The internal combustion engine of claim 1, wherein there is one intake valve for each cylinder, and one exhaust valve for each intake valve.

3. The internal combustion engine of claim 1, wherein there are two intake valves for each cylinder, and one exhaust valve for each intake valve.

4. The internal combustion engine of claim 1, wherein said exhaust valve has a cross sectional area in a range of fifty to sixty-five percent of the cross sectional area of said intake valve.

* * * * *